US007040932B1

(12) United States Patent
Klitzner

(10) Patent No.: US 7,040,932 B1
(45) Date of Patent: May 9, 2006

(54) COLLAPSIBLE PLUG

(76) Inventor: Orrin Edward Klitzner, 29 Lee Hill Rd., Andover, NJ (US) 07821

( * ) Notice: Subject to any disclaimer, the term of this patent is extended or adjusted under 35 U.S.C. 154(b) by 0 days.

(21) Appl. No.: 11/160,217

(22) Filed: Jun. 14, 2005

(51) Int. Cl.
*H01R 24/04* (2006.01)

(52) U.S. Cl. ..... 439/668

(58) Field of Classification Search ..... 439/668, 439/669, 265, 170; 361/90, 680, 681
See application file for complete search history.

(56) References Cited

U.S. PATENT DOCUMENTS

| | | | | |
|---|---|---|---|---|
| 4,753,598 | A * | 6/1988 | Gignac et al. | 439/11 |
| 5,237,488 | A * | 8/1993 | Moser et al. | 361/681 |
| 5,475,626 | A * | 12/1995 | Viletto | 361/680 |
| 5,628,641 | A * | 5/1997 | Hahn | 439/131 |
| 5,648,712 | A * | 7/1997 | Hahn | 320/111 |
| 5,658,152 | A | 8/1997 | Selker | 439/31 |
| 5,681,171 | A | 10/1997 | Park | 439/31 |
| 5,681,176 | A * | 10/1997 | Ibaraki et al. | 439/165 |
| 5,997,310 | A | 12/1999 | Chiu et al. | 439/21 |
| 6,089,874 | A | 7/2000 | Kroulik et al. | 439/11 |
| 6,190,180 | B1 | 2/2001 | Purington et al. | 439/17 |
| 6,494,746 | B1 * | 12/2002 | D'Addario | 439/668 |
| 6,551,142 | B1 | 4/2003 | Eisenbraun | 439/668 |
| 6,687,513 | B1 | 2/2004 | Hsu Li | 455/557 |
| 6,709,297 | B1 | 3/2004 | Lee | 439/638 |
| 6,755,694 | B1 * | 6/2004 | Ries et al. | 439/668 |
| 6,786,734 | B1 * | 9/2004 | Yu | 439/11 |
| 6,786,743 | B1 | 9/2004 | Huang | 439/131 |
| 6,902,436 | B1 * | 6/2005 | Liao | 439/668 |
| 6,902,437 | B1 * | 6/2005 | Wang | 439/668 |
| 6,913,478 | B1 * | 7/2005 | Lamirey | 439/259 |
| 2004/0023520 | A1 | 2/2004 | Schriefer | 439/11 |
| 2004/0085694 | A1 * | 5/2004 | Germagian et al. | D3/301 |

FOREIGN PATENT DOCUMENTS

| | | |
|---|---|---|
| JP | 11-214099 | 8/1999 |

* cited by examiner

*Primary Examiner*—Tulsidas C. Patel
*Assistant Examiner*—Harshad Patel
(74) *Attorney, Agent, or Firm*—Stephen Christopher Swift; Swift Law Office

(57) ABSTRACT

A collapsible plug that can fit into a motor vehicle's cigarette lighter. It comprises two flat members that are generally rectangular, except at one end where they are semicircular. The members are pivotally connected at an axis midway between their longer edges. The members may be rotated around the axis so that they lie together in a flat position for storage. The members may be rotated in an opposite direction, until they are at right angles to each other, in an open position in which they may be retained in a cigarette lighter. The semicircular ends of the members are inserted into the cigarette lighter. Electricity is conducted from contacts on the flat edges and the semicircular ends of the members to a cord on the opposite end of the collapsible plug, and through the cord to a second plug, where it can power a portable electronic device.

14 Claims, 5 Drawing Sheets

COLLAPSIBLE PLUG

BACKGROUND OF THE INVENTION

1. Field of the Invention

The present invention relates to collapsible plugs, designed to fit into cigarette lighter sockets of motor vehicles.

2. Description of the Prior Art

There have been prior inventions of plugs that can pivot or rotate, but none that are equivalent to the present invention.

U.S. Pat. No. 4,753,598, issued on Jun. 28, 1988, to Ivan J. Gignac and Earl J. Fleck, discloses a pivoting electrical contact, comprising a pair of contacts disposed in holes in a retaining member that pivots about a longitudinal centerline. The instant invention is distinguishable, in that it has a pair of flat members.

U.S. Pat. No. 5,658,152, issued on Aug. 19, 1997, to Edwin Joseph Selker, discloses a three-prong swivel plug, with male and female plugs that pivot about a common axis between first and second positions. The instant invention is distinguishable, in that it has a pair of flat members.

U.S. Pat. No. 5,681,171, issued on Oct. 28, 1997, to Seon-Kyu Park, discloses a pivotable multiple pin cable connector, with a housing defining a turning hollow, and a head with a lower portion inserted into the hollow of the housing.

U.S. Pat. No. 5,997,310, issued on Dec. 7, 1999, to Pen-Li Chiu and Wen-Chin Chien, discloses a swivel electric plug, with a base block with grooves into which annular metal plates are fastened, and a circular cover plate.

U.S. Pat. No. 6,089,874, issued on Jul. 18, 2000, to Erwin K. Kroulik, Richard J. Balaguer and Timothy J. Jones, discloses a rotatable electrical connector, that allows for limited twisting movement between cables or cords coupled to it, by absorbing such twisting movement in shunts inside the connector.

U.S. Pat. No. 6,190,180, issued on Feb. 20, 2001, to Kim Purington, Jeffrey Powers and Robert J. Wright, discloses a swiveling electrical connector, comprising male and female coupling assemblies which rotate relative to each other when connected.

U.S. Pat. No. 6,551,142, issued on Apr. 22, 2003, to Kenneth D. Eisenbraun, discloses a vehicle cigarette lighter connector, having a barrel insertable into a cigarette lighter socket, a body pivotably secured to the barrel, and a cable extending from the body. The body also includes a female connector. A pair of pivotably connected flat members, as in the instant invention, is not disclosed.

U.S. Pat. No. 6,687,513, issued on Feb. 3, 2004, to Hsiu-Chu Hsu Li, discloses a device for attaching a portable phone to a vehicle, having a generally cylindrical plug that can fit into a cigarette lighter.

U.S. Pat. No. 6,709,297, issued on Mar. 23, 2004, to Dominic Lee, discloses a multi-directional swiveling outlet adaptor, including a plug assembly for connecting to a power source, and a multiple outlet module rotatably coupled to the plug assembly.

U.S. Pat. No. 6,786,734, issued on Sep. 7, 2004, to Chun-Chain Yu, discloses an electrical adapter with a foldable housing having two parts that are pivotably connected at their ends. The instant invention is distinguishable, in that it has two flat members that are pivotably connected about a axis midway between the long edges of each member.

U.S. Pat. No. 6,786,743, issued on Sep. 7, 2004, to Yea Yen Huang, discloses a connecting hub assembly having a universal joint, with a housing having a first connector, and a joint device having a second connector, with the joint device pivotably attached to the housing.

U.S. Patent Application Publication No. 2004/0023520, published on Feb. 5, 2004, to Tavis D. Schriefer, discloses connector devices that provide multiple degrees of freedom of motion between a first connector head and additional connector heads and/or electronic devices. The instant invention is distinguishable, in that it only provides one degree of freedom of motion between two flat members configured for insertion in a cigarette lighter plug.

Japanese Patent No. 11-214099, published on Aug. 6, 1999, to Norio Kato, discloses a plug that can fit into a cigarette lighter, which is pivotably connected to holder into which a cellular telephone can be plugged.

None of the above inventions and patents, taken either singly or in combination, is seen to describe the instant invention as claimed.

SUMMARY OF THE INVENTION

The present invention is a collapsible plug that can fit into a motor vehicle's cigarette lighter (or similar female electric plug). It comprises two flat members that are generally rectangular, except at one end where they are semicircular. The members are pivotally connected at an axis midway between their longer edges. The members may be rotated around the axis so that they lie together in a flat position for storage (e.g., in a pocket, glove compartment, purse, or a holster for a cell phone). The members may be rotated in an opposite direction, until they are at right angles to each other, in an open position in which they may be retained in a cigarette lighter. The semicircular ends of the members are inserted into the cigarette lighter. Electricity is conducted from contacts on the flat edges and the semicircular ends of the members to a cord on the opposite end of the collapsible plug, and through the cord to a second plug, where it can power a portable electronic device. The collapsible plug may be combined with a holster for the portable electronic device, or it may be built into any portable electronic device.

Accordingly, it is a principal object of the invention to provide a convenient means of powering a portable electric device from a motor vehicle's cigarette lighter socket.

It is another object of the invention to provide a convenient means of recharging the battery of a portable electric device from a motor vehicle's cigarette lighter socket.

It is a further object of the invention to provide a plug that can fit into a motor vehicle's cigarette lighter socket, but can be folded away for storage when not in use.

Still another object of the invention is to provide a plug that can be combined with a holster for a portable electronic device.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a collapsible plug that may be inserted into the cigarette lighter socket of an automobile (or other motor vehicle) to power a portable electrically-powered device (including, but not limited to, cellular telephones, laptop computers, personal digital assistants ("PDAs"), game players, or music players (e.g., Ipod, MP3, CD or cassette players)).

Figure 1:
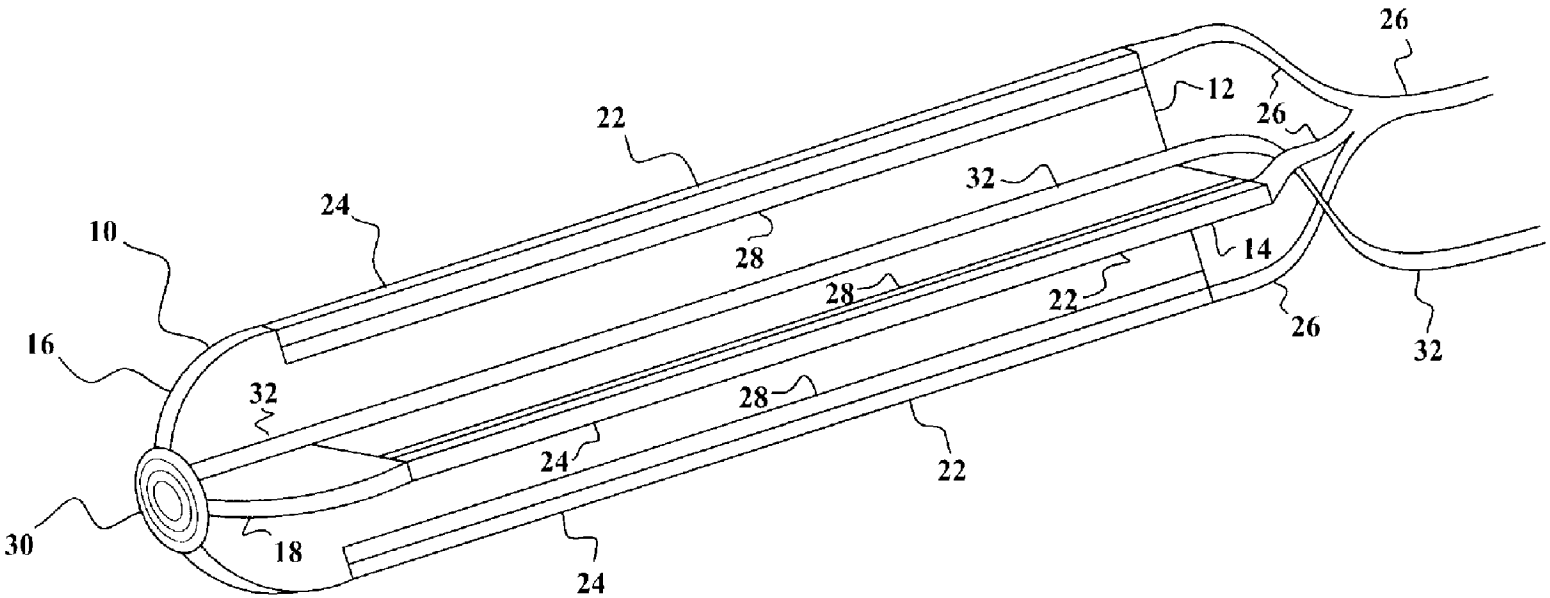
FIG. 1 is a perspective view of the first preferred embodiment of the invention, showing the collapsible plug in an open position.

FIG. 1 is a perspective view of the first preferred embodiment of the invention, showing the collapsible plug 10 in an open position. The collapsible plug comprises two flat, generally rectangular members 12 and 14, which have rounded ends 16 and 18. They are pivotally connected where they intersect at their centerlines. There are first electrical contacts 22 at the elongated edges 24 of each flat member. (All four of the elongated edges may have these first electrical contacts, or alternatively, they may be at only one, two, or three of the edges of the flat members.) The elongated edges and the first electrical contacts are suitably dimensioned and configured to contact the negative cylindrical inside surface of a cigarette lighter socket. The first electrical contacts are electrically connected to a first wire 26. Elastic material 28 is an optional feature that helps to securely retain the edges of the flat members and the first electrical contacts against the cylindrical inside surface of the socket. (The elastic material may be a non-conductive material, bowed metal, springs, or other suitable material. The elastic material may be placed at edges of the flat members, as shown in the drawings, or near their intersection.) A second electrical contact 30 is preferably placed at the intersection of the rounded ends of the flat members. (The second electrical contact may be joined to either or both of the flat members.) The second electrical contact is electrically connected to a second wire 32. The second electrical contact is designed to contact the positive center of the inside flat surface of the cigarette lighter socket.

Figure 2:
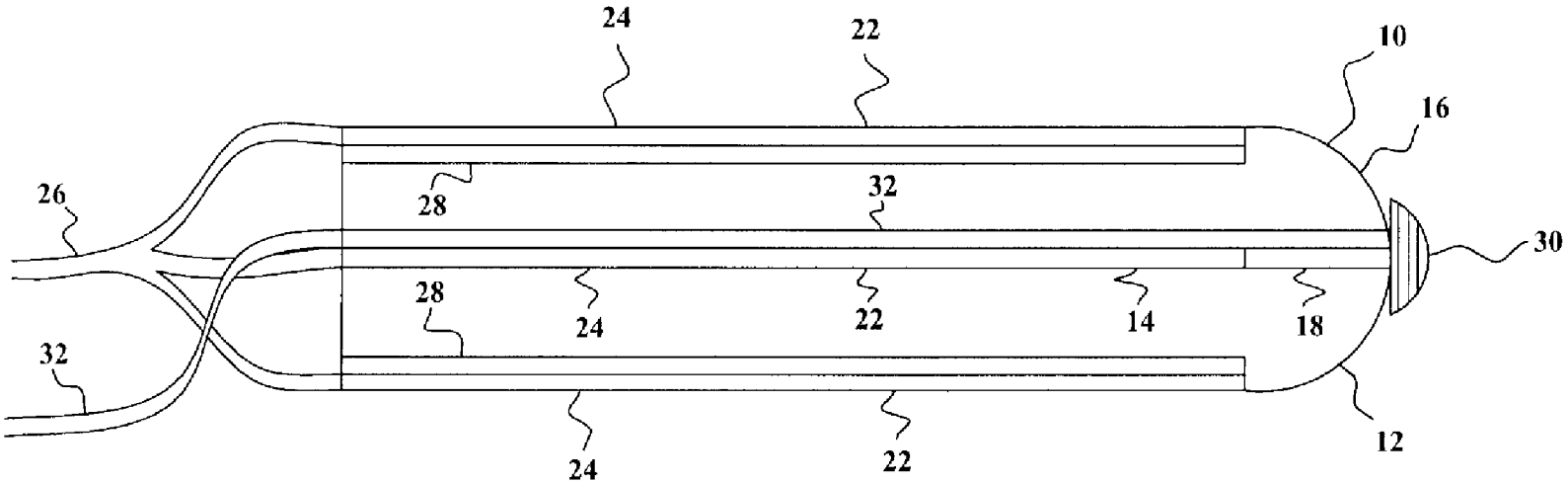
FIG. 2 is a left side elevational view of the first preferred embodiment of the invention in the open position.
Figure 3:
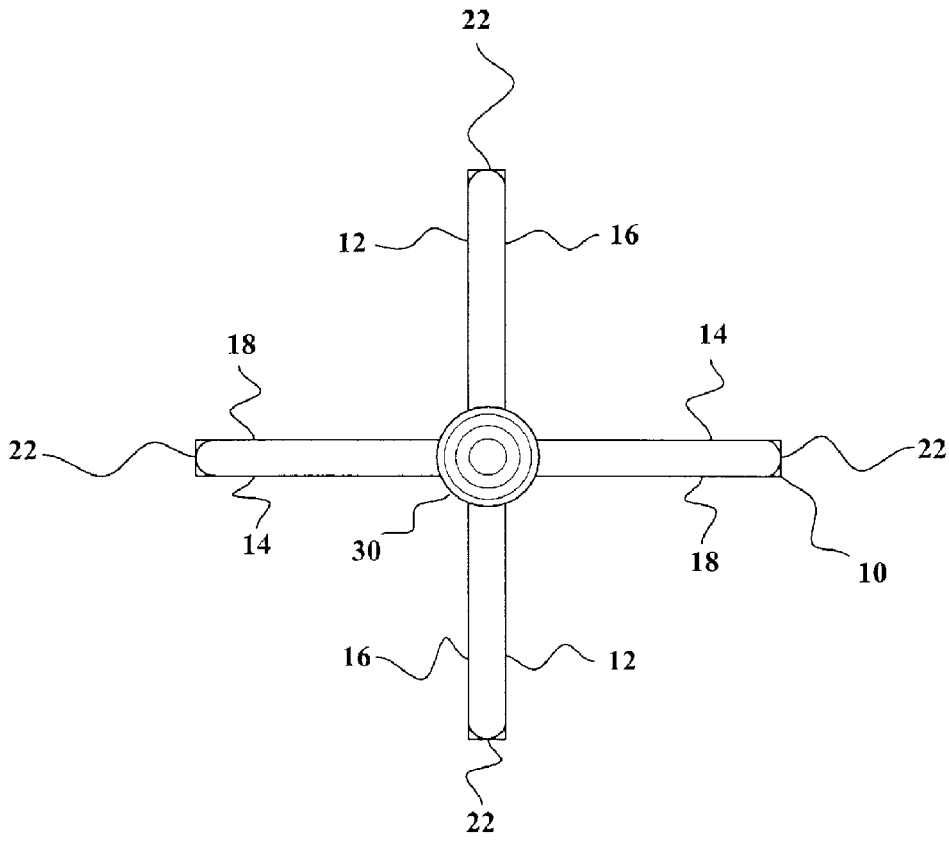
FIG. 3 is a front elevational view of the first preferred embodiment of the invention in the open position.
Figure 4:
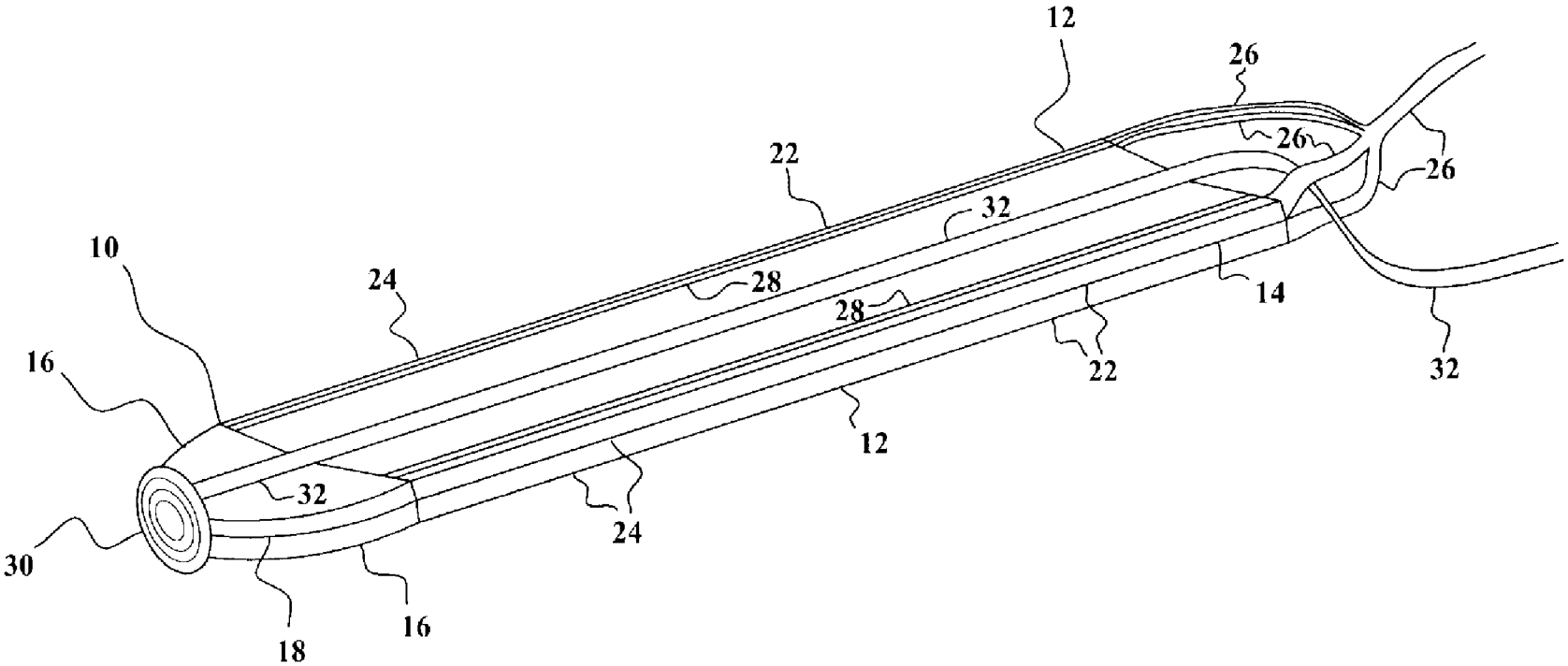
FIG. 4 is a perspective view of the first preferred embodiment of the invention in a closed position.

FIG. 2 is a left side elevational view of the first preferred embodiment of the invention in the open position. FIG. 3 is a front elevational view of the first preferred embodiment of the invention in the open position. In the open position, the flat members are preferably at right angles from each other. FIG. 4 is a perspective view of the first preferred embodiment of the invention in a closed position. In the closed position, the flat members lie against each other. The open position is for use; the closed position is for storage. The flat members may be made of any suitable stiff, non-conductive material. Springs or latches (not shown in the drawings) may be used to hold the flat members in either the open or the closed position. Micro-electronics (not shown in the drawings) may be incorporated in the flat members to transform the standard twelve volts in an automobile cigarette lighter to a voltage appropriate for the device being powered.

The invention may be used to directly energize the portable device, or to recharge a battery in the device. When the first preferred embodiment is used to directly energize the device, an electric circuit is closed that includes the negative cylindrical inside surface of the cigarette lighter socket, the first electrical contact, the first wire, the portable device, the second wire, the second electrical contact, and the positive center of the flat inside surface of the socket, thereby energizing the device. When the first preferred embodiment is used to recharge the battery in the device, an electric circuit is closed that includes the negative cylindrical inside surface of the cigarette lighter socket, the first electrical contact, the first wire, the positive pole of the device's battery, the negative pole of the device's battery, the second wire, the second electrical contact, and the positive center of the flat inside surface of the socket, thereby recharging said battery.

Figure 5:
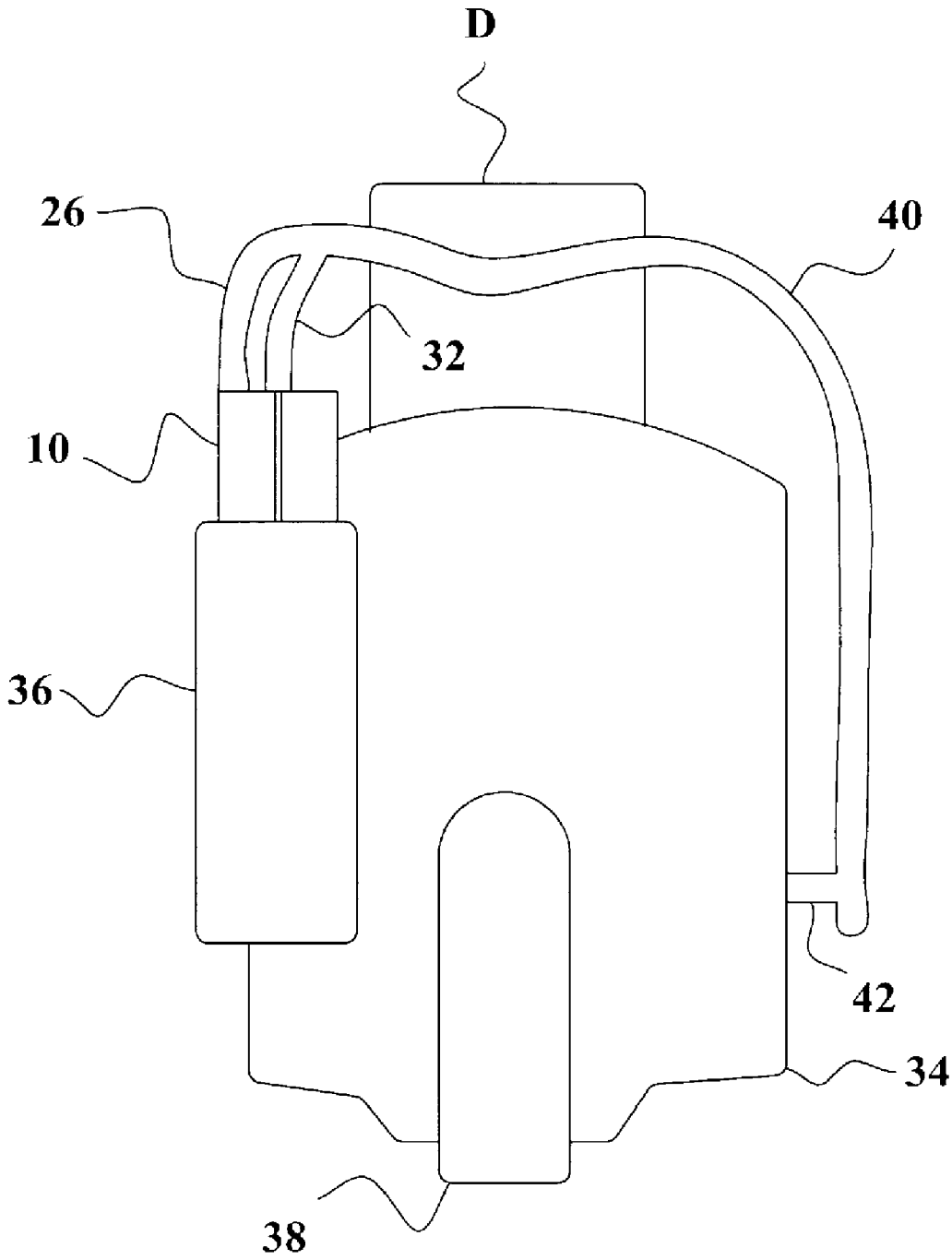
FIG. 5 is a front elevational view of the second preferred embodiment of the invention.

FIG. 5 is a front elevational view of the second preferred embodiment of the invention, in which the collapsible plug 10 is combined with a holster 34 for a portable device D. The collapsible plug is retained in the closed position in a holder 36 when it is not in use. The holster may be retained on a user's belt or in a user's pocket using clip 38. The first wire 26 and the second wire 32 are joined into one cord 40 connected to a non-collapsible plug 42 that is inserted into the portable device. The non-collapsible plug has positive and negative poles (not shown in the drawings). When the second preferred embodiment is used to directly energize the device, an electric circuit is closed that includes the negative cylindrical inside surface of the cigarette lighter socket, the first electrical contact, the first wire, the first pole of the non-collapsible plug, the portable device, the second pole of the non-collapsible plug, the second wire, the second electrical contact, and the positive center of the flat inside surface of the socket, thereby energizing the device.

When the second preferred embodiment is used to recharge the batter in the device, an electric circuit is closed that includes the negative cylindrical inside surface of the cigarette lighter socket, the first electrical contact, the first wire, the first pole of the non-collapsible plug, the positive pole of said battery, the negative pole of said battery, the second pole of the non-collapsible plug, the second wire, the second electrical contact, and the positive center of the flat inside surface of the socket, thereby recharging said battery.

It is to be understood that the present invention is not limited to the embodiments described above, but encompasses any and all embodiments within the scope of the following claims.

What is claimed is:

1. A collapsible plug, comprising:

two flat members that are pivotally connected, so that the said flat members can be rotated between an open position in which outside edges of said flat members are spaced apart from each other, and a closed position in which said outside edges lie against each other;

a first electrical contact on at least one of the outside edges of at least one of the flat members;

a second electrical contact on an end of at least one of the flat members;

a first wire electrically connected to the first electrical contact; and a second wire electrically connected to the second electrical contact;

wherein said outside edges of said flat members are parallel, but said flat members each have one rounded end, with the rounded ends of the two flat members being adjacent;

wherein said flat members are at right angles to each other in the open position; and wherein the flat members are configured so that they can be inserted into a motor vehicle cigarette lighter socket, with their outside edges and the first electrical contact touching the cylindrical inside surface of the socket, and their rounded ends and the second electrical contact touching the center of the flat inside surface of the socket.

2. The collapsible plug according to claim 1, wherein:

the outside edges of the flat members are biased outward by an elastic material, so as to insure close contact with the cylindrical inside surface of the socket.

3. The collapsible plug according to claim 1, wherein:

the wires are adapted to be electrically connected to a portable electrically-powered device, so as to close an electric circuit including the negative cylindrical inside surface of the cigarette lighter socket, the first electrical contact, the first wire, the portable device, the second wire, the second electrical contact, and the positive center of the flat inside surface of the socket, thereby energizing the device.

4. The collapsible plug according to claim 1, wherein:

the wires are adapted to be electrically connected to opposite poles of a battery for a portable electrically-powered device, so as to close an electric circuit including the negative cylindrical inside surface of the cigarette lighter socket, the first electrical contact, the first wire, the positive pole of said battery, the negative pole of said battery, the second wire, the second electrical contact, and the positive center of the flat inside surface of the socket, thereby recharging said battery.

5. A collapsible plug in combination with a holster for a portable electrically-powered device, comprising:

a holster configured to retain a portable electrically-powered device, said holster having a non-collapsible plug with a first pole and a second pole;

a collapsible plug having two flat members that are pivotally connected, so that the said flat members can be rotated between an open position in which outside edges of said flat members are spaced apart from each other, and a closed position in which said outside edges lie against each other;

a first electrical contact on at least one outside edge of at least one of the flat members;

a second electrical contact on an end of at least one of the flat members;

a first wire electrically connected to the first electrical contact and to the first pole of the non-collapsible plug; and a second wire electrically connected to the second electrical contact and to the second pole of the non-collapsible plug;

wherein said outside edges of said flat members are parallel, but said flat members each have one rounded end, with the rounded ends of the two flat members being adjacent;

wherein said flat members are at right angles to each other in the open position; and wherein the flat members are suitably dimensioned and configured so that said flat members can be inserted into a motor vehicle cigarette lighter socket, with their outside edges and the first electrical contact touching the cylindrical inside surface of the socket, and their rounded ends and the second electrical contact touching the center of the flat inside surface of the socket.

6. The collapsible plug in combination with a holster for a portable electrically-powered device according to claim 5, wherein:

the outside edges of the flat members are biased outward by an elastic material, so as to insure close contact with the cylindrical inside surface of the socket.

7. The collapsible plug in combination with a holster for a portable electrically-powered device according to claim 5, wherein:

the collapsible plug is adapted to be electrically connected to the portable electrically-powered device, so as to close an electric circuit including the negative cylindrical inside surface of the cigarette lighter socket, the first electrical contact, the first wire, the first pole of the non-collapsible plug, the portable device, the second pole of the non-collapsible plug, the second wire, the second electrical contact, and the positive center of the flat inside surface of the socket, thereby energizing the device.

8. The collapsible plug in combination with a holster for a portable electrically-powered device according to claim 5, wherein:

the collapsible plug is adapted to be electrically connected to opposite poles of a battery for the portable electrically-powered device, so as to close an electric circuit including the negative cylindrical inside surface of the cigarette lighter socket, the first electrical contact, the first wire, the first pole of the non-collapsible plug, the positive pole of said battery, the negative pole of said battery, the second pole of the non-collapsible plug, the second wire, the second electrical contact, and the positive center of the flat inside surface of the socket, thereby recharging said battery.

9. A method of providing electric power to a portable device, comprising the steps of:

connecting a collapsible plug to a portable electrically-powered device, said collapsible plug having two flat members that are configured so that said flat members can be inserted into a motor vehicle cigarette lighter socket, said flat members being pivotally connected, so that they can be rotated between an open position in which outside edges of said flat members are spaced apart from each other, and a closed position in which said outside edges lie against each other, and said collapsible plug also having a first electrical contact on at least one outside edge of at least one of the flat members, a second electrical contact on an end of at least one of the flat members, a first wire electrically connected to the first electrical contact, and a second wire electrically connected to the second electrical contact;

rotating the flat members to an open position, if they are in a closed position; and inserting the collapsible plug into the cigarette lighter socket, with said outside edges of the flat members and the first electrical contact touching the cylindrical inside surface of the socket, and the second electrical contact touching the center of the flat inside surface of the socket.

10. The method of providing electric power to a portable device according to claim 9, wherein:

the outside edges of the flat members are parallel, but the flat members each have one rounded end, with the rounded ends of the two flat members being adjacent, and the second electrical contact being on at least one of the rounded ends.

11. The method of providing electric power to a portable device according to claim 10, wherein:

the flat members are at right angles to each other in the open position.

12. The method of providing electric power to a portable device according to claim 11, wherein:

the outside edges of the flat members are biased outward by an elastic material, so as to insure close contact with the cylindrical inside surface of the socket.

13. The method of providing electric power to a portable device according to claim 11, wherein:

the wires are connected to the portable electrically-powered device, in such a manner as to close an electric circuit including the negative cylindrical inside surface of the cigarette lighter socket, the first electrical contact, the first wire, the portable device, the second wire, the second electrical contact, and the positive center of the flat inside surface of the socket, thereby energizing the device.

14. The method of providing electric power to a portable device according to claim 11, wherein:

the wires are connected to opposite poles of a battery for the portable electrically-powered device, in such a manner as to close an electric circuit including the negative cylindrical inside surface of the cigarette lighter socket, the first electrical contact, the first wire, the positive pole of said battery, the negative pole of said battery, the second wire, the second electrical contact, and the positive center of the flat inside surface of the socket, thereby recharging said battery.

* * * * *